United States Patent [19]

Macchi

[11] 4,345,740

[45] Aug. 24, 1982

[54] TENSIONING SYSTEM FOR CABLES IN PRESTRESSED CONCRETE

[76] Inventor: Romualdo Macchi, Via S. Paolo 31, Pisa, Italy

[21] Appl. No.: 188,721

[22] Filed: Sep. 19, 1980

[30] Foreign Application Priority Data

Sep. 28, 1979 [IT] Italy ..... 9550 A/79

[51] Int. Cl.[3] ..... E04C 5/08

[52] U.S. Cl. ..... 254/29 A; 52/223 L; 254/231

[58] Field of Search ..... 254/231, 232, 233, 234, 254/235, 236, 29 A; 52/699, 713, 223 R, 223 L; 297/134, 132

[56] References Cited

U.S. PATENT DOCUMENTS

| | | | |
|---|---|---|---|
| 2,728,978 | 1/1956 | Birkenmaier | 254/29 A X |
| 3,387,417 | 6/1968 | Howlett | 52/223 L |
| 3,439,462 | 4/1969 | Suzuki et al. | 52/223 R |
| 4,065,098 | 12/1977 | Siegwart et al. | 254/29 A |

*Primary Examiner*—Billy S. Taylor

[57] ABSTRACT

A system for tensioning stranded or wire cables in prestressed concrete comprises an anchoring head having holes in which are anchored the strands or wires. The anchoring head has a ring in screw-threaded engagement with an exterior surface of the head for providing a reactive support for the anchoring head. An intermediate member is releasably fixed to the anchoring head by rods which extend through holes in the intermediate member and are in screw-threaded engagement with the anchoring head. The intermediate member also has a screw-threaded exterior for engagement with the ring to allow the ring to provide a reactive support for the intermediate member at intermediate stages in a tensioning operation.

The intermediate member is releasably connectable to a tensioning jack thus allowing the jack and the intermediate member to be removed from the anchoring head once tensioning is complete.

4 Claims, 10 Drawing Figures

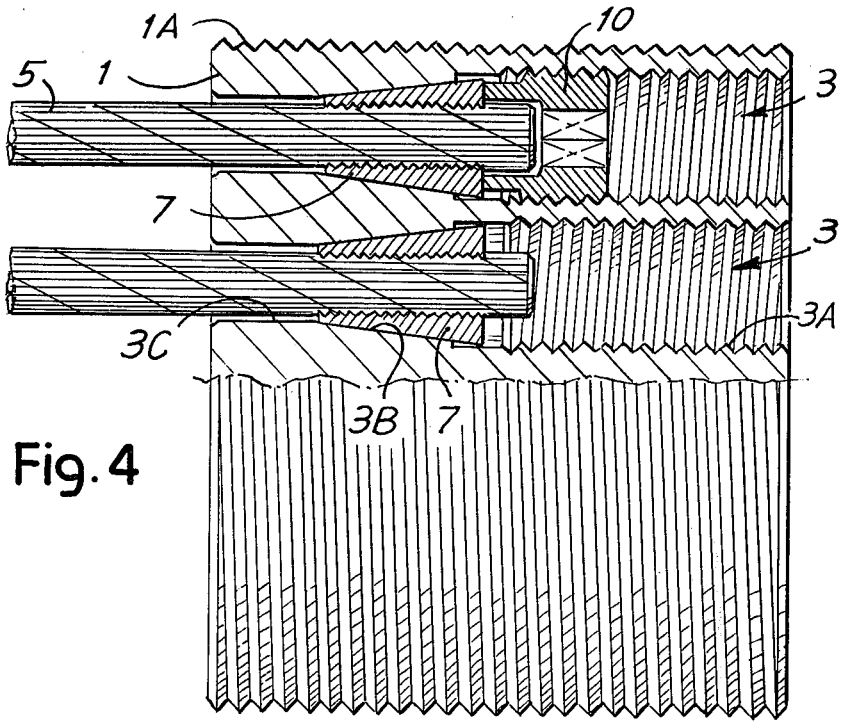
Fig. 4
Fig. 5
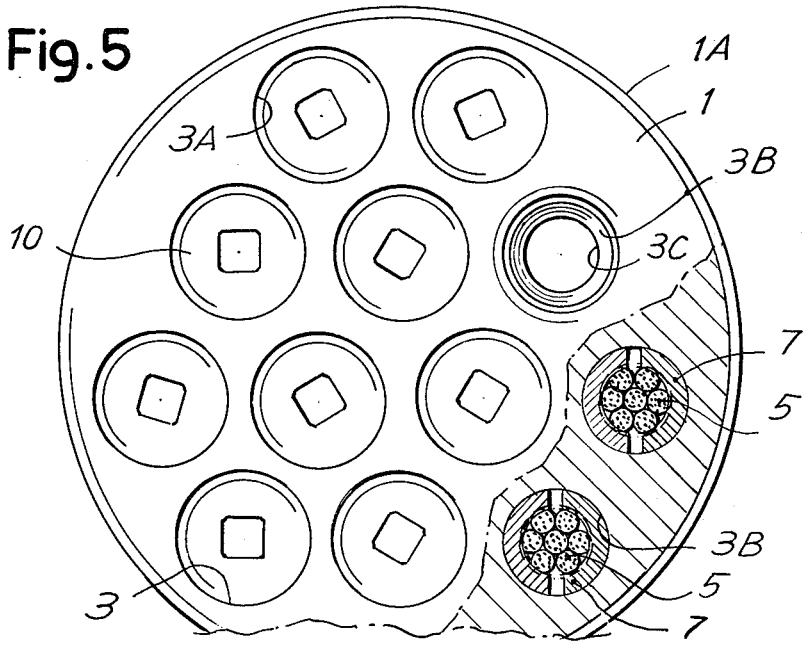

TENSIONING SYSTEM FOR CABLES IN PRESTRESSED CONCRETE

BACKGROUND TO THE INVENTION

The invention relates to tensioning systems for cables in prestressed concrete.

A conventional tensioning system for cables made up of strands requires the strands to be cut to a size greater than the required length of the cable. This additional length is required to allow a jack to grip the strands at their free ends and thus tension them by stretching them.

The locking of the strands on the jack and on an anchoring head through which the strands pass to the jack is effected by, for example, means of wedge anchorages.

Such a system has the following disadvantages.

The jack in such a system has substantial size and weight and it is necessary, therefore, to have sufficient space around the ends of the cables to maneuver the jack and this space is not always available. It is also necessary to have lifting means for the jack which remain in use throughout the tensioning of the cable. In addition, the outer dimensions of such jacks cause considerable inconvenience and lengthen the time taken to complete tensioning; for example, during the prestressing of continuous beams with joined cables, or at cantilevered points, the time taken in tensioning the cables determines the rate at which the complete job is performed, and therefore affects the cost of the job.

The additional length of the individual strands is a waste of material, which, in percentage terms, is greater in shorter cables than in longer cables.

The determination of the extent of the final lengthening of the cable, formed, for example of 12 to 31 strands of 0.5" size, is uncertain because of the variations of the bedding of the wedges in the anchoring head, each time the cable is blocked. This uncertainty is greater when the cable is tensioned in several stages. In such cases, every time the cable is blocked at an intermediate stage and then released to continue with the tensioning, there is an increased variation in the bedding of the wedges and the value of the force required to release the wedges. Thus, the value of the final lengthening cannot be estimated with accuracy. Further, the use of steel strands with high breaking stresses, and with final stresses in the strands very close to the yield stress of the strands, makes a knowledge of the exact value of the final elongation even more important, particularly if the cables are short and the percentage incidence of error is quite substantial.

When it is required to slacken completely a cable already stretched to the limit, it is necessary to apply excess tension to the strands to release them from the wedges and, in so doing, particularly if the cable is short, the excess stress may cause the stress in the cables to exceed admissible values. In addition, in such an operation, the use of the single jack used for stretching is not advisable, because it is preferable to slacken the individual strands one by one, using a special small-size jack. Thus, such a slackening operation is lengthy and dangerous.

Modern, sophisticated constructional methods, and the use of materials with ever-increasing strength characteristics, require prestressing systems which are precise, simple, safe and fast.

It is an object of the invention, therefore, to provide a system for tensioning the strands or wires of a cable in which the aforementioned disadvantages are mitigated or overcome.

SUMMARY OF THE INVENTION

According to a first aspect of the invention, there is provided, in a system for tensioning stranded or wire cables in prestressed concrete and comprising an anchoring head, means defining a plurality of holes into which an end of each strand or wire extends, anchoring means within each said hole for anchoring each said end to the anchoring head, a screw-threaded external surface on the anchoring head, a ring in threaded engagement with the exterior surface of the anchoring head for engagement with a support to hold the anchoring head in a position in which the cables is tensioned, the improvement comprising an intermediate member, means defining a plurality of holes extending through the intermediate member, rods extending through each said hole defining means in the intermediate member, and in screw-threaded engagement with a respective one of the hole defining means in the anchoring head to lock the intermediate member to the anchoring head, a screw-threaded exterior surface on the intermediate member for engagement with the ring to hold the intermediate member, during tensioning of the cable, in fixed positions, means on the intermediate member for releasable engagement with a jack for tensioning the cable, whereby the jack and the intermediate member can be removed from the anchoring head when tensioning is complete.

According to a second aspect of the invention, there is provided a member for use in tensioning a cable formed of strands or wires in prestressed concrete, each strand or wire being anchored in respective means defining a hole in an anchoring head and the anchoring head having an exterior surface thereof in screw-threaded engagement with a ring for providing a reactive support for the anchoring head, the member comprising a cylindrical body, means defining a plurality of holes extending through the body for the receipt of rods which pass through the hole defining means and threadedly engaged in the hole defining means in the anchoring head to releasably lock the member and the anchoring head together, means for engaging the member with a jack for tensioning the cables, and an external screw thread on the cylindrical body for engagement with the ring to allow the ring to provide a reactive support for the member at intermediate stages during tensioning of the cable.

BRIEF DESCRIPTION OF THE DRAWINGS

The following is a more detailed description of one embodiment of the invention, by way of example, reference being made to the accompanying drawings in which:

FIG. 4 is a view, on an enlarged scale, of the left-hand end of the system of FIG. 1, FIG. 5 is an end elevation, partly in section, of the system of FIG. 1, and FIGS. 6 to 10 are side elevations of a concrete structure showing successive stages in the use of the system of FIG. 1.

DESCRIPTION OF THE PREFERRED EMBODIMENTS

Figure 2:
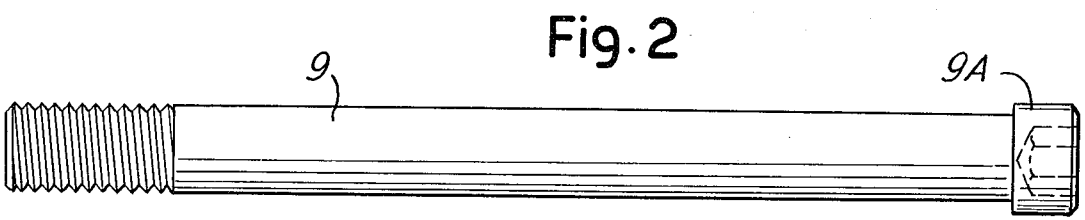
FIG. 2 is a side elevation of a rod of the system of FIG. 1.
Figure 1:
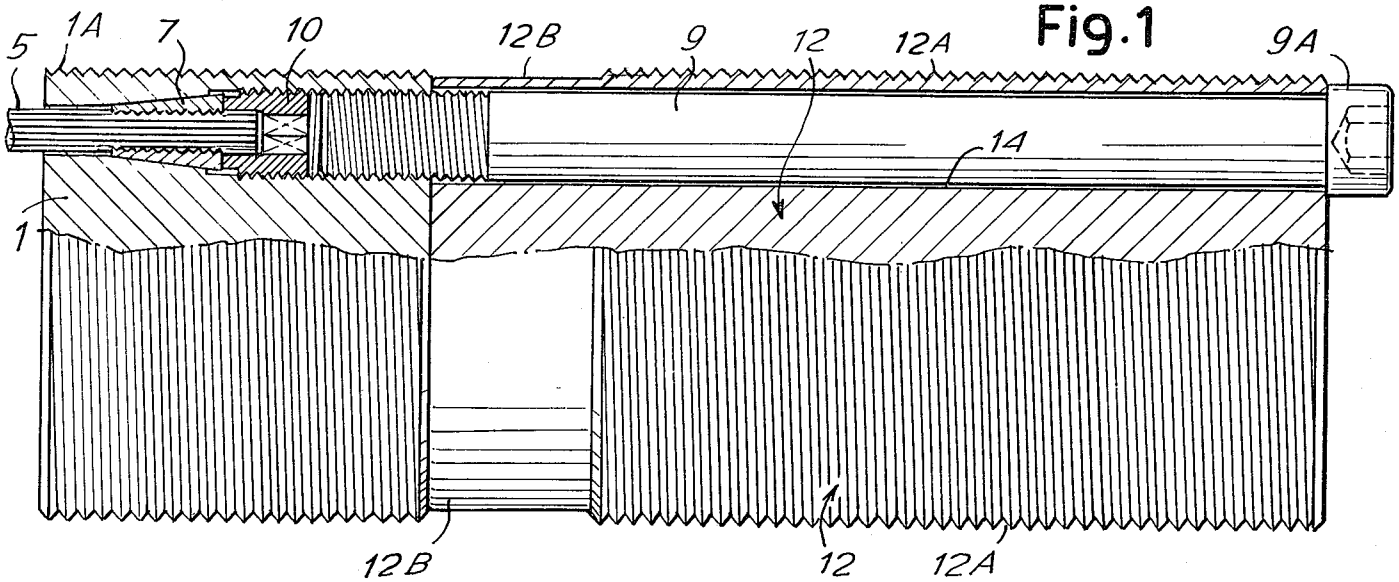
FIG. 1 is a side elevation, partly in section of a rope or wire tensioning system.

The system comprises a mobile anchoring head 1 in the form of a metal cylinder, having external threads 1A and having, extending therethrough, as many holes 3—disposed, for example, in honeycomb fashion (see FIG. 5)—as there are strands 5 in a cable to be anchored. Each hole 3 has a threaded cylindrical portion 3A (see FIG. 4) of greater diameter than the remainder of the hole 3, a part in the shape of a truncated cone 3B, and, optionally, a stretch 3C of smaller diameter than the minimum diameter of the truncated cone 3B. The part 3B in the shape of a truncated cone is used to anchor the associated strand 5 to the anchoring head 1 by means, for example, of toothed wedges 7 (see FIGS. 1 and 4), while the threaded cylindrical portion 3A acts as a female thread for a special small threaded rod 9 (see FIGS. 1 and 2). The rods 9 screwed into the holes 3 are used for gripping the mobile head and for stretching the cable. As shown in FIG. 1, wedge member 7 is partially extended from the conical portion of hole 3 in the head 1 and the toothed surface thereof is grippingly engaged with strands 5.

The anchoring of each individual strand 5 to the mobile head 1 can be achieved other than with wedges 7, for example with extruded cylindrical sleeves, or in any other way which permits attachment of the cables and the head 1 at a place at which the strands are produced and which anchors the strands 5 to the head in a stable and positive manner before the strands 5 are stretched.

Figure 3:
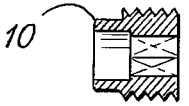
FIG. 3 is a cross-sectional view of a threaded washer of the system of FIG. 1.

To connect the strands 5 to the head 1, the strands 5 are all cut to the same measurement, the various strands are threaded into the relevant holes 3 of the anchoring head 1 and are anchored in the head 1. In the case illustrated, the locking wedges 7 are positioned in the portions 3B of the holes 3 and are pushed towards the narrower ends of the portions 3B by, for example, respective threaded washers 10 (see FIG. 3) screwed into the threads of the portions 3A of the holes 3, until they exert on the wedges 7 an exact required locking force to guarantee, when the cable is tensioned, the immediate anchoring of every strand 5. When the wedges 7 are initially locked by means of the threaded washers 10, adjusted by a torque spanner, this prevents unlocking of the wedges 7 during transport and installation of the cable. The washers 10 are recoverable for re-use after stretching, or they may be left in the head 1 which receives them. Final locking may also be achieved in some other suitable way.

To connect the mobile head 1 to the jack and thus to tension the cable, an intermediate member is used comprising an extractor cylinder 12 which has the same diameter as the head 1 and is threaded externally at 12A along the majority of the length thereof, the pitch of the thread being the same as the pitch of the thread 1A on the head 1. A short, unthreaded stretch 12B is provided and the cylinder 12 has as many holes 14 extending therethrough as there are corresponding holes 3 in the mobile head 1, the holes 14 being disposed in register with the holes 3. Into each of the holes 14, one of the small threaded rods 9 is introduced, with a threaded end of the rod 9 in engagement with the threaded portion 3A of the associated hole 3 in the anchoring head 1 until a thickened portion or end head 9A of the rod 9, engages with the outer face of the extractor cylinder 12 to make the cylinder 12 solid with the mobile head 1. All the connecting rods 9 are advantageously tightened to the same degree by means of a torque spanner, so that the force exerted by the extractor cylinder 12 on the mobile head is uniform.

Figure 6:
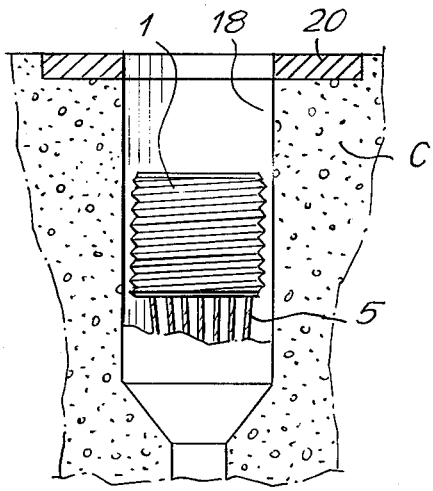
Figure 7:
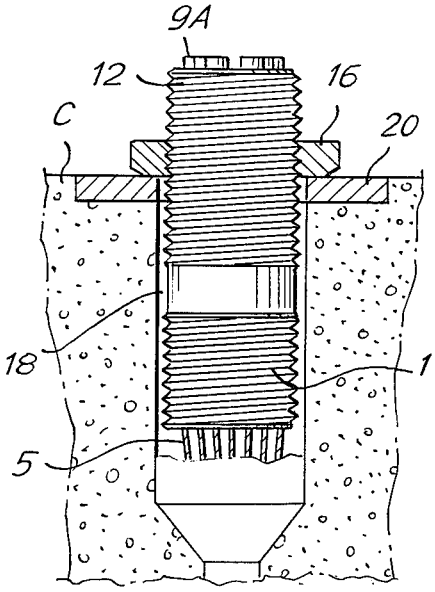

The length of the extracting cylinder 12 is such that a locking ring nut 16, which can be screwed on the thread 12A as well as on the thread 1A, may be screwed onto the extractor 12 before tensioning starts. This nut may also be used to easily center the unit formed by the mobile head 1 and the extractor 12 in a housing hole 18 (FIGS. 6 and 7) made in the concrete structure C and provided with a reactive or distribution plate 20 which provides a centering mark for the nut 16.

Figure 8:
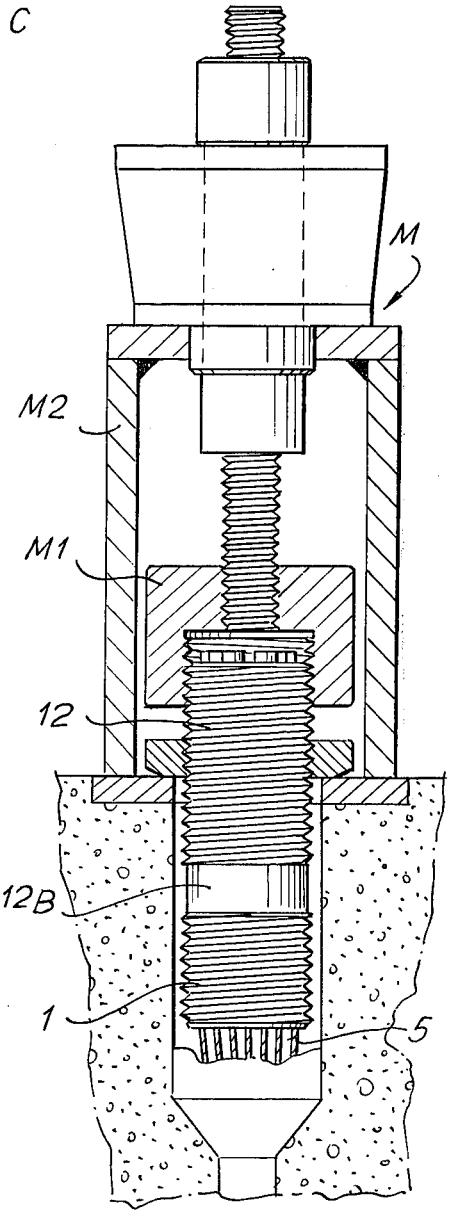
Figure 9:
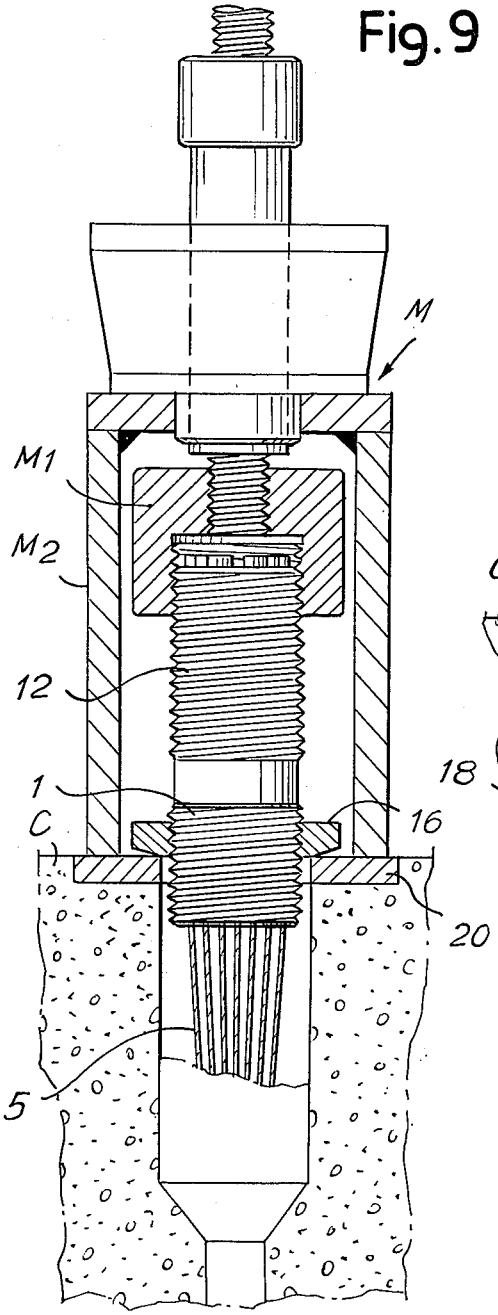

The part of the extractor 12 which protrudes beyond the lock nut 16, is in threaded engagement with the drive head M1 of a jack M (FIG. 8) and thus the cable is stretched by operation of the jack M to force the part M2 to push on the plate 20 (FIG. 9).

The mobile head 1 and the extractor 12 form a single unit and therefore the stretching of a cable—whether short or long—can be regulated simply, quickly, reliably, and accurately by the coupling between the nut 16 and the threaded head.

Figure 10:
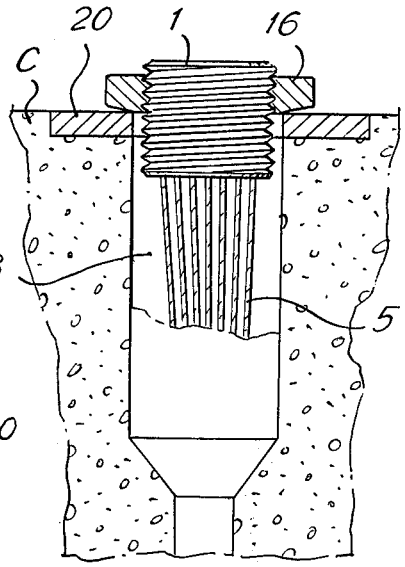

With this system it is possible to stretch, in one operation, or in stages, the nut 16 being screwed along the thread 12A during stretching. After the nut 16 has passed the area 12B, the nut 16 engages on the thread 1A of the head 1 to allow removal of the cylinder 12 and the jack M (see FIG. 10). It is also possible to slacken partly or completely a cable which is already completely stretched, while allowing measurement—with the maximum accuracy and at any time—of the actual lengthening of the cable, without overstressing the cable in so doing, and using simple and reliable jacks with a minimum weight and size. For example, the tensioning of cable to an initial stress of 350 tonnes can be performed by two operators without the help of lifting means and by use of jacks weighing a few dozen kilos.

Thus, in the system described above with reference to the drawings, the strands or wires can be cut beforehand to the required final length and anchored only once in a mobile head. When the desired elongation has been achieved, the head, by means of an internally threaded nut, transmits the prestressing force to a distribution plate on the concrete.

The system described above with reference to the drawings may be applied to mobile anchoring heads for wires (i.e. reinforcing rods) made of steel and of circular section, instead of strands.

I claim:

1. In a system for tensioning strand cables in prestressed concrete of the type having an anchoring head, means defining a plurality of holes in the anchoring head into which an end of each strand or wire extends, anchoring means within each of said hole for anchoring each said end to the anchoring head, a screw-threaded external surface on the anchoring head, a ring threadably engaged with the external surface of the anchoring head for engagement with a support to hold the anchoring head in a position in which the cables are tensioned, the improvement comprising:

an intermediate member;

means defining a plurality of holes extending through the intermediate member, wherein the means defining holes in the intermediate member define as many holes as the means defining holes in the anchoring head, with the holes in the intermediate member being in register with the holes in the anchoring head;

the exterior surface of the intermediate member having an axially extending non-threaded portion between a portion having the screw-threaded exterior surface thereof and the anchoring head for allowing the ring to be disengaged from the thread on the intermediate member and then engaged on the thread of the anchoring head;

rods extending through each said hole defining means in the intermediate member, and screw-threadably engaged with a respective one of the hole defining means in the anchoring head to lock the intermediate member to the anchoring head;

a screw-threaded exterior surface on the intermediate member for engagement with the ring to hold the intermediate member, during tensioning of the cable, in fixed positions;

a thread on the intermediate member for releasable engagement with a jack for tensioning the cable, whereby the jack and the intermediate member can be removed from the anchoring head when tensioning is complete.

2. A system according to claim 1 wherein each rod includes a head which engages on an exterior surface of the intermediate member to hold the intermediate member against the anchoring head.

3. A system according to claim 1, wherein said means defining holes in the intermediate member includes an interior threaded portion, and a conical portion adjacent to said interior threaded portion, and further comprising wedge means mounted at least partially in said conical portion for grippingly engaging a strand extended through the respective hole in the intermediate member, and a washer threadably engaged to said interior threaded portion and abutted to said wedge means for locking said wedge means in place.

4. A system according to claim 3, wherein said wedge means includes a bore longitudinally extended therethrough, and means defining a toothed surface adjacent said bore for grippingly engaging said respective strand.

* * * * *